US005816852A

United States Patent [19]

Conrad

[11] Patent Number: 5,816,852

[45] Date of Patent: Oct. 6, 1998

[54] BUS BAR AND CROSS CONNECTION FOR A SERIES TERMINAL AND METHOD FOR PRODUCING THE BUS BAR

[76] Inventor: Gerd Conrad, Mastbruchstrasse 213A, D-33104 Paderborn, Germany

[21] Appl. No.: 686,593

[22] Filed: Jul. 26, 1996

Related U.S. Application Data

[63] Continuation of PCT/EP95/01484, Apr. 20, 1995.

[30] Foreign Application Priority Data

Apr. 22, 1994 [DE] Germany ..... 44 14 148.3

[51] Int. Cl.[6] ..... H01R 31/08

[52] U.S. Cl. ..... 439/512; 439/810

[58] Field of Search ..... 174/68.2, 72 B, 174/71 B, 70 B, 88 B, 99 B; 439/212, 213, 507, 512, 513, 510, 511, 704, 710, 722, 723, 810

[56] References Cited

U.S. PATENT DOCUMENTS 3,804,970 4/1974 Oldman ..... 174/72 B
5,007,888 4/1991 Goutiere ..... 439/507
5,071,356 12/1991 Strate et al. ..... 439/49
5,162,616 11/1992 Swaffield et al. ..... 174/70 B

OTHER PUBLICATIONS

3550 Viiid/21c Jul. 1956 Germany.

*Primary Examiner*—Neil Abrams
*Assistant Examiner*—Barry M. L. Standing
*Attorney, Agent, or Firm*—Herbert L. Lerner; Laurence A. Greenberg

[57] ABSTRACT

A bus bar for a series terminal includes a round rod having end portions with two sides and parallel surfaces on both of the sides. A cross connection for a bus bar includes a flat material having a longitudinal direction and a top part. The flat material has a longer first slit extending centrally therein in the longitudinal direction forming at least two U-shaped clamps being joined together in the top part. The clamps each have one shorter second slit therein forming clamp tongues with free ends. The free ends have circular-arc-shaped recesses formed therein being adapted to a diameter of a round rod of a bus bar. A method for producing a bus bar for a series terminal includes cold forming end portions of a round rod of a conductor material having an original round shape, to form parallel surfaces on both sides and a middle region retaining the original round shape.

6 Claims, 4 Drawing Sheets

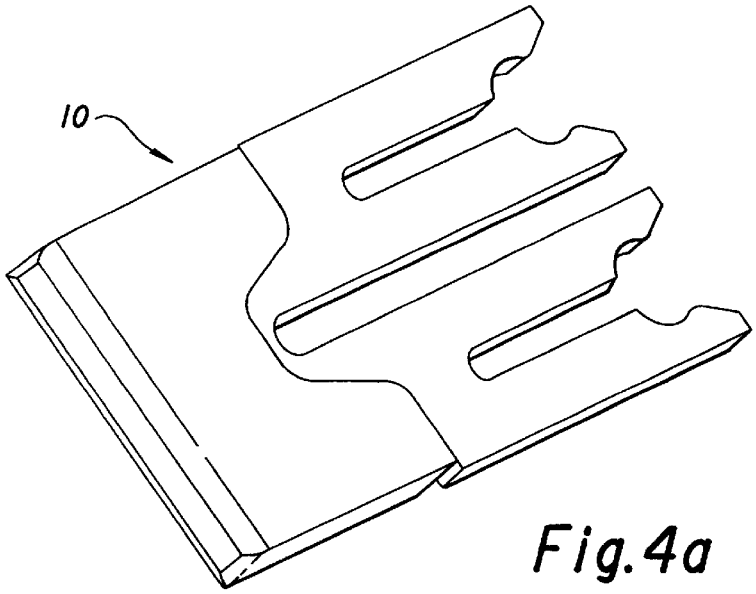
Fig.4a
Fig.4b
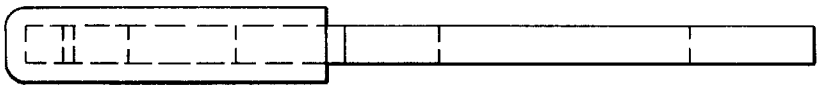
Fig.4c
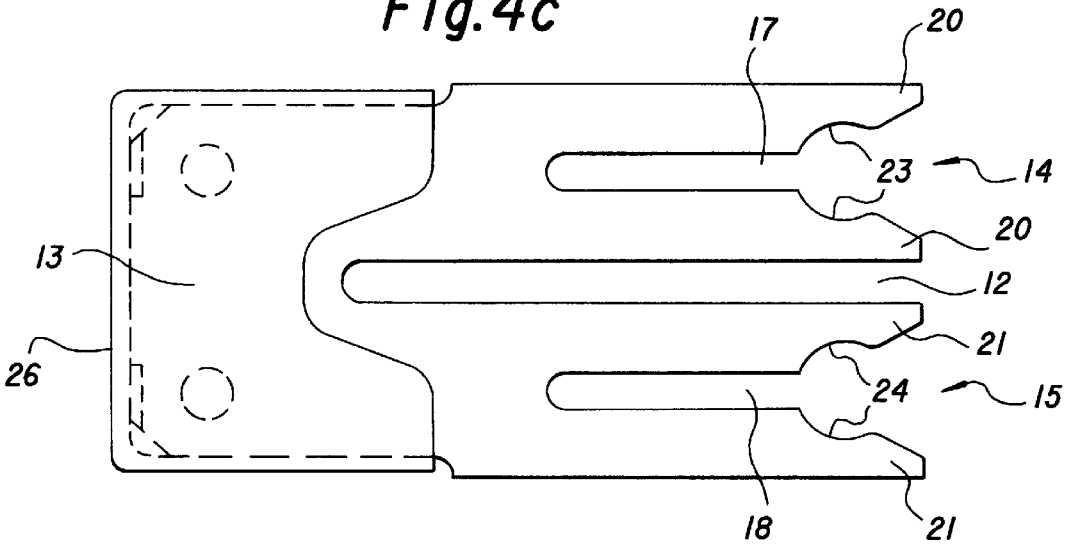

BUS BAR AND CROSS CONNECTION FOR A SERIES TERMINAL AND METHOD FOR PRODUCING THE BUS BAR

CROSS-REFERENCE TO RELATED APPLICATION

This application is a Continuation of International Application Serial No. PCT/EP95/01484, filed Apr. 20, 1995.

BACKGROUND OF THE INVENTION

1. Field of the Invention

The invention relates to a bus bar for a series terminal, a cross connection suitable for the bus bar and a method for producing the bus bar.

It is known to provide a bus bar of a flat conductor material or a profiled lengthwise bar between connection points of a series terminal.

In that connection Swiss Patent CH 521 671 describes a contact piece with a continuous longitudinal groove of V-shaped cross section. Bus bars made of open or closed flat hollow-profile tubes are shown in German Application Sch 3550 VIIId/21c, and a specially shaped bus bar made of a flat material is described in Published European Patent Application 0 082 285 B1.

SUMMARY OF THE INVENTION

It is accordingly an object of the invention to provide a bus bar and cross connection for a series terminal and a method for producing the bus bar, which overcome the hereinafore-mentioned disadvantages of the heretofore-known devices and methods of this general type, in which the bus bar is simpler and above all more economical to make than the known bus bars of the prior art and in which the cross connection that is adapted to the novel bus bar is to be used for a crosswise bridge between the bus bars of adjacent series terminals.

German Patent DE 33 12 002 C1 already discloses cross connections for series terminals that are made of a flat material and have at least two pairs of clamp tongues to make an electrical connection between bus bars of adjacent series terminals. The pairs of clamp tongues which are joined together along a crosswise strip are disposed with their flat plane rotated by 90° as compared to the crosswise strip. The clamp tongues, in the mounted state of the cross connection, engage insertion openings of the bus bars. A similar embodiment of a cross connection is also shown in German Published, Non-Prosecuted Patent Application DE 36 25 240 A1.

The novel cross connection is simpler to make, because it involves only a single stamping operation without any additional work step. Another substantial advantage over the known cross connections is considered to be the special adaptation to the diameter of the round rod of the bus bar.

With the foregoing and other objects in view there is provided, in accordance with the invention, a bus bar for a series terminal, comprising a round rod having end portions with two sides and parallel surfaces on both of the sides.

With the objects of the invention in view there is also provided a cross connection for the bus bar, comprising a flat material having a longitudinal direction and a top part; the flat material having a longer first slit extending centrally therein in the longitudinal direction forming at least two U-shaped clamps being joined together in the top part; and the clamps each having one shorter second slit therein forming clamp tongues with free ends, the free ends having circular-arc-shaped recesses formed therein being adapted to the diameter of the round rod of the bus bar.

In accordance with another feature of the invention, the free ends of the clamp tongues have slit outlets being widened like a wedge.

In accordance with a further feature of the invention, there is provided an insulating cap disposed on the flat material.

With the objects of the invention in view there is additionally provided a method for producing a bus bar for a series terminal, which comprises cold forming end portions of a round rod of a conductor material having an original round shape, to form parallel surfaces on both sides and a middle region retaining the original round shape.

In accordance with a concomitant mode of the invention, there is provided a method which comprises carrying out the cold forming step on copper conductor material.

The invention contemplates using normal copper wire, which can be supplied in the form of standard products, as the starting material. The wire only undergoes cold forming, but not metal-cutting machining. Standard copper wire is substantially less expensive than the flat material used heretofore, and moreover there is no waste in the form of trimmings of material produced by stamping.

Other features which are considered as characteristic for the invention are set forth in the appended claims.

Although the invention is illustrated and described herein as embodied in a bus bar and a cross connection for a series terminal and a method for producing the bus bar, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 4*a*, 4*b* and 4*c* are respective perspective, side-elevational and plan views of a cross connection.

DESCRIPTION OF THE PREFERRED EMBODIMENTS

Figure 2A:
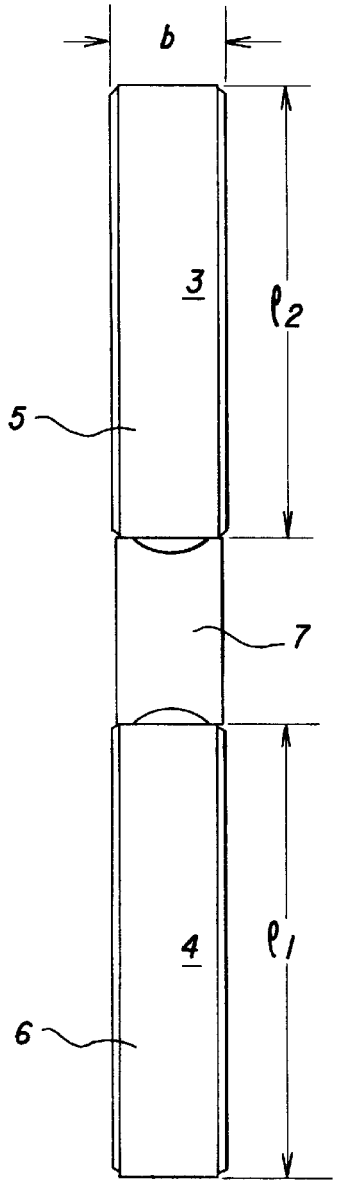
FIGS. 2*a*, 2*b* and 2*c* are respective front-elevational, side-elevational and plan views of the bus bar of FIG. 1.
Figure 2B:
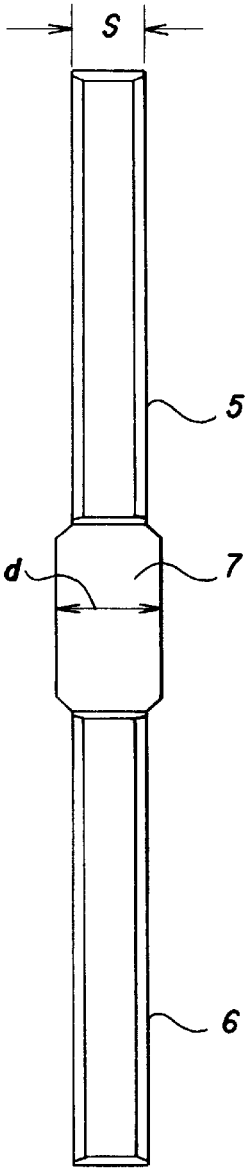
Figure 1:
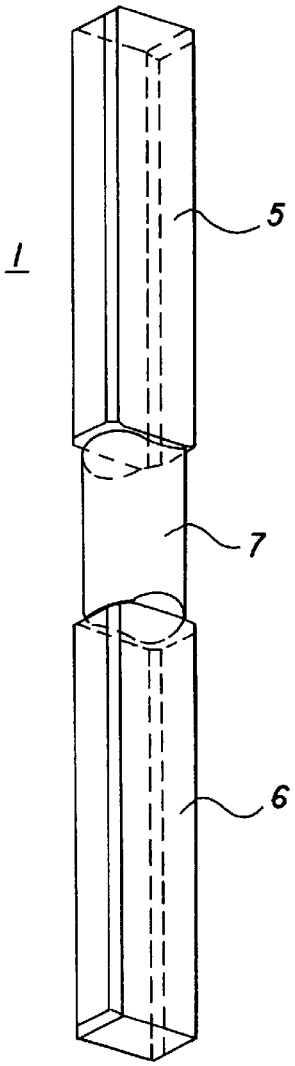
FIG. 1 is a perspective view of a bus bar according to the invention.
Figure 2C:
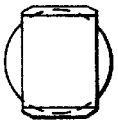
Figure 3:
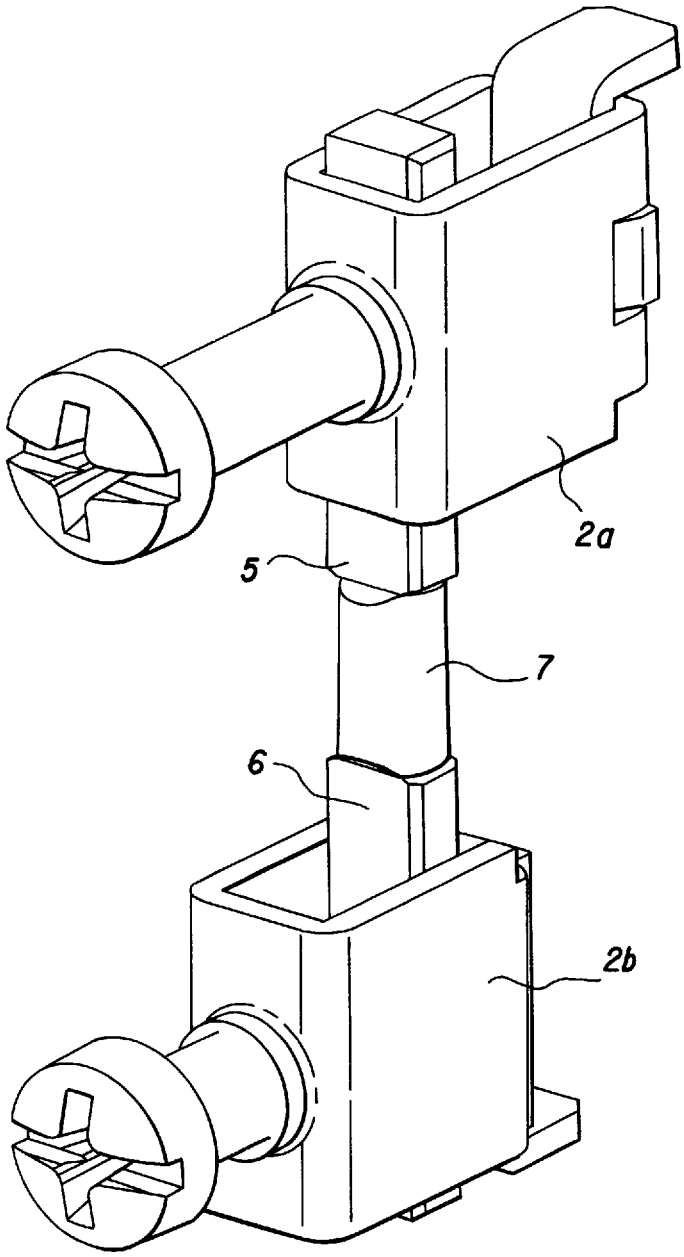
FIG. 3 is a perspective view showing the disposition of a bus bar between two tension brackets of a series terminal (without a plastic housing)

Referring now to the figures of the drawings in detail and first, particularly, to FIGS. 1, 2*a*, 2*b* and 2*c* thereof, there is seen a bus bar 1 which is produced from a commercially available copper wire having a circular cross section with a diameter d shown in FIG. 2*b*. The total length of the bus bar 1 will depend substantially on outer dimensions of a series terminal width or external spacings from tension brackets 2*a* and 2*b* (shown in FIG. 3) to be joined. In order to produce a bus bar according to the invention, a round rod of that length must be cut from the commercially available solid copper wire and compressed in a press by cold forming on its two ends with respective lengths $l_1$ and $l_2$ shown in FIG. 2*a*, in such a way that parallel surfaces 5 and 6 are produced on both sides of the round rod in the vicinity of end portions 3 and 4. As is shown in FIG. 2*a*, a width b of these surfaces of the end portions is accordingly increased in comparison with the diameter d (shown in FIG. 2*b*) of a round middle region 7 of the round rod. A spacing 5 of the parallel surfaces 5 and 6 is the result of identical cross-sectional areas of the end portions 3 and 4 and of the middle round region 7. In FIG. 3, the disposition of a bus bar 1 between the two tension brackets 2*a* and 2*b* of a series terminal is shown. A plastic housing and an insulating body with its securing base for disposition on a support rail are not shown. The tension bracket 2*a* is shown in the opened state, for instance for receiving a cable, while the tension bracket 2*b* is shown in the closed state with a tightened clamping screw.

FIGS. 4*a*–4*c* show an exemplary embodiment of a cross connection 10, which permits an electrically conductive connection to be made between the bus bars 1 of two adjacent series terminals having the tension brackets 2*a*, 2*b*. The perspective view in FIG. 4*a* and the plan view in FIG. 4*c* show that the rectangularly constructed cross connection has two clamps 14 and 15 which are joined together in a top region 13, as a result of a longer first slit 12 disposed in the longitudinal axis. Each of the two clamps includes two clamp tongues 20 and 21 which are each formed by a respective shorter second slit 17 and 18. The tongues 20, 21 have circular-arc-shaped recesses 23 and 24 on their respective free ends. The recesses 23, 24 are adapted to the diameter of the middle region 7 of the bus bar 1. As can be seen from FIG. 4*b*, the flat material of the cross connection 10 has an adequate thickness so that the detent clamping of the clamps 14 and 15 on the cylindrical middle regions 7 of the bus bars assures a secure electrical contact. The top region 13 of the cross connection 10 is protected with an insulating cap 26 for insulation reasons and for avoiding incorrect connections.

Figure 5A:
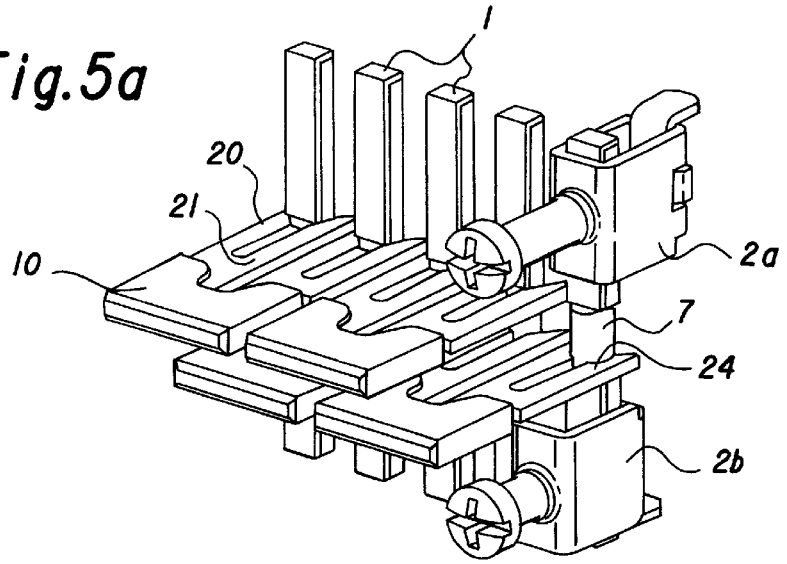
FIGS. 5*a*, 5*b* and 5*c* are respective perspective, front-elevational and side-elevational views of a configuration of the cross connections on the bus bars.
Figure 5C:
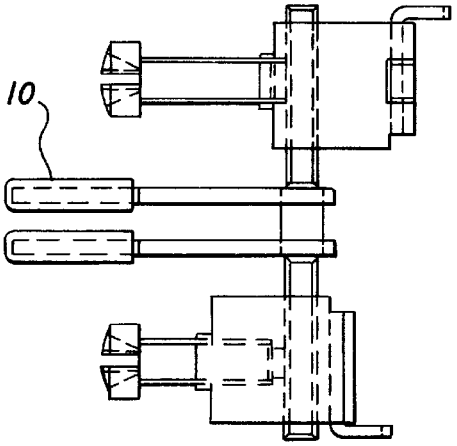
Figure 5B:
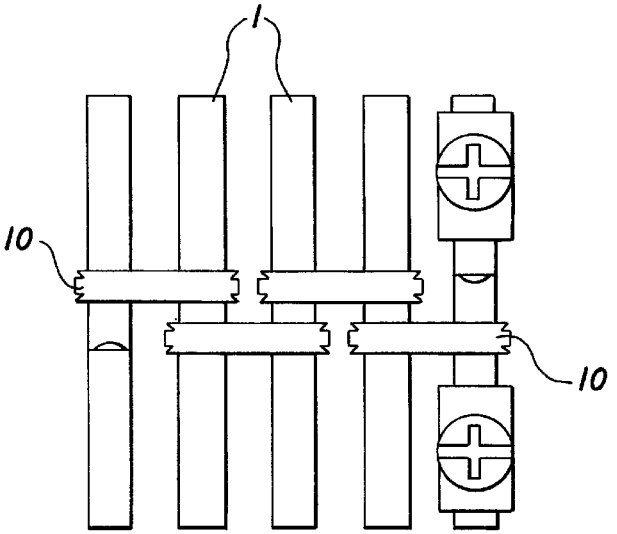

FIGS. 5*a*–5*c* show the way in which the cross connections 10 are clamped to the bus bars 1 at a plurality of series terminals which are located side by side. For the sake of simplicity, the plastic housings of the series terminals are not shown. The drawing shows five series terminals or bus bars 1 and four cross connections 10 which are disposed in two planes, overlapping one another. It could also be advantageous to provide cross connections each having four clamps 14 and 15, for example. However, the cross connection 10 with two clamps as shown permits more favorable storage.

I claim:

1. A bus bar for a series terminal, comprising a body member having a middle portion with a first end, a second end and a circular cross-section, a first end portion and a second end portion attached to said first end and said second end respectively, each of said first and said second end portion having two sides and parallel surfaces on both of said sides.

2. A cross connection for a bus bar, comprising:

a flat material having a longitudinal direction and a top part;

said flat material having a longer first slit extending centrally therein in the longitudinal direction forming at least two U-shaped clamps being joined together in said top part; and said clamps each having one shorter second slit therein forming clamp tongues with free ends, said free ends having circular-arc-shaped recesses formed therein for receiving a round rod of a bus bar.

3. The cross connection according to claim 2, wherein said free ends of said clamp tongues have tapered slit outlets for assisting in guiding the bus bar into said circular-arc-shaped recesses.

4. The cross connection according to claim 3, including an insulating cap disposed on said flat material.

5. A multiple bus bar for series terminal, comprising:

bus bars disposed next to each other for connecting to electrical conductors, said bus bars being formed from a round bar and each having a middle portion with two ends and a circular cross-section, and first and second end portions joined to each of said ends of said middle portion, said first and second end portions each having two sides with parallel surfaces on both of said sides;

at least one cross connection having a flat body member for engaging and interconnecting said bus bars, said flat body member having a longitudinal direction and a top part;

said flat body member having a longer first slit extending centrally therein in the longitudinal direction forming at least two arms being joined together in said top part; and said arms each having one shorter second slit therein forming clamping tongues with free ends, said free ends having circular-arc-shaped recesses formed therein for receiving and securing said middle portion of said bus bars.

6. A bus bar and cross connection assembly, comprising:

a bus bar including a round rod with a diameter and end portions, said end portions having two sides and parallel surfaces on both of said sides; and a cross connection for said bus bar, said cross connection including a flat material having a longitudinal direction and a top part;

said flat material having a longer first slit extending centrally therein in the longitudinal direction forming at least two U-shaped clamps being joined together in said top part; and said clamps each having one shorter second slit therein forming clamp tongues with free ends, said free ends having circular-arc-shaped recesses formed therein for receiving said round rod of said bus bar.

* * * * *